US009763011B2

(12) United States Patent
Li et al.

(10) Patent No.: US 9,763,011 B2
(45) Date of Patent: Sep. 12, 2017

(54) SPEAKER

(71) Applicant: Goertek, Inc., Weifang, ShanDong Province (CN)

(72) Inventors: Zhi Li, Weifang (CN); Qijing Jiao, Weifang (CN); Jianbin Yang, Weifang (CN)

(73) Assignee: GOERTEK, INC., Weifang, ShanDong Province (CN)

( * ) Notice: Subject to any disclaimer, the term of this patent is extended or adjusted under 35 U.S.C. 154(b) by 0 days.

(21) Appl. No.: 14/769,974

(22) PCT Filed: Mar. 27, 2015

(86) PCT No.: PCT/CN2015/075194
§ 371 (c)(1),
(2) Date: Aug. 24, 2015

(87) PCT Pub. No.: WO2016/062007
PCT Pub. Date: Apr. 28, 2016

(65) Prior Publication Data

US 2016/0261957 A1 Sep. 8, 2016

(30) Foreign Application Priority Data

Oct. 24, 2014 (CN) ..... 2014 1 0579432

(51) Int. Cl.
*H04R 1/00* (2006.01)
*H04R 9/02* (2006.01)
(Continued)

(52) U.S. Cl.
CPC ..... *H04R 9/025* (2013.01); *H04R 9/06* (2013.01); *H04R 31/006* (2013.01)

(58) Field of Classification Search
CPC .... H04R 9/06; H04R 9/025; H04R 2209/022; H04R 2400/00; H04R 9/63; H04R 9/00; F16J 15/54; H02K 49/106
(Continued)

(56) References Cited

U.S. PATENT DOCUMENTS 5,081,684 A * 1/1992 House ..... H04R 7/18 381/407
2003/0138125 A1* 7/2003 Yu ..... H04R 9/06 381/412

(Continued)

FOREIGN PATENT DOCUMENTS

CN 202435603 9/2012
JP 1981027600 3/1981

OTHER PUBLICATIONS

CN Appln. No. 201410579432.2, The Notification of the First Office Action, dated Mar. 27, 2017, 5 pages.

*Primary Examiner* — Md S Elahee
*Assistant Examiner* — Julie X Dang
(74) *Attorney, Agent, or Firm* — Boyle Fredrickson, S.C.

(57) ABSTRACT

The present invention discloses a speaker relating to the technical field of electro-acoustic products, including a housing in which a vibration system and a magnetic system are contained, the magnetic system including a magnet and a magnetic permeability piece combined together, several slits are provided on at least one component of the magnet and the magnetic permeability piece, the depths of the respective slits all extend in a horizontal direction and the lengths of the respective slits all extend in a vertical direction. The speaker of the present invention solves the technical problems in prior art of more components, high cost, difficult assembly etc. of the speaker. The speaker of the present invention also has the advantages of less components, low production cost, simple assembly and easy opera-
(Continued)

tion, high production efficiency, a high qualified rate of the end product, a remarkable acoustic performance, etc. while solving the technical problems of the eddy current loss and second harmonic distortion, etc.

9 Claims, 5 Drawing Sheets

(51) Int. Cl.
*H04R 9/06* (2006.01)
*H04R 31/00* (2006.01)

(58) Field of Classification Search
USPC ..... 381/74, 202, 194, 199, 164, 433, 396, 381/398, 400–418, 420–425; 277/629; 384/446
See application file for complete search history.

(56) References Cited

U.S. PATENT DOCUMENTS

2005/0041831 A1* 2/2005 Stiles ..... H04R 9/022 381/412
2009/0261531 A1* 10/2009 Deshpande ..... H02K 49/106 277/629
2013/0039528 A1* 2/2013 Peng ..... H04R 9/045 381/400
2015/0260191 A1* 9/2015 Blankemeier ..... F04D 13/025 417/420

* cited by examiner

SPEAKER

TECHNICAL FIELD

The present invention relates to the technical field of electro-acoustic products, in particular to a speaker.

BACKGROUND ART

A speaker is an acoustic part for completing the conversion between an electrical signal and a sound signal and is an energy conversion device. The speaker includes a housing within which a vibration system and a magnetic system is contained. The vibration system includes a folding ring, a connector, a dome, a skeleton voice coil and a damper combined together, and the magnetic system includes a washer, a magnet and a magnetic permeability piece combined together. A magnetic gap is provided between the washer and the magnet and a magnetic permeability piece. The end portion of the skeleton voice coil with windings winded is located within the magnetic gap. The skeleton voice coil makes up and down movement within the magnetic gap according to the acoustic electrical signal passing through the windings thereof. An induced electromotive force will be generated while the skeleton voice coil makes up and down movement in the magnetic field. A modulated magnetic field will be generated by the current of the sonic signal and the induced electromotive force. An eddy current will be generated in the washer, the magnet and the magnetic permeability piece by the modulated magnetic field, which reduces the energy of the magnetic field and at the same time cause the second harmonic distortion of the speaker, thus affecting the acoustic performance of the speaker.

The current main method for solving the above-said problem is to mount a short circuit ring in the speaker. Though the short circuit ring eliminates the above defect, it increases the internal components of the speaker, which increases the production cost, at the same time also increases the complexity and difficulty of the assembling of the speaker, increases the probability of bad assembling and reduces the production efficiency and the qualified rate of the end product of the speaker.

SUMMARY OF THE INVENTION

In view of the above defect, the technical problem to be solved by the present invention is to provide a speaker which can solve the technical problem of causing an eddy current and second harmonic distortion in the magnet without increasing a short circuit ring, and which also has advantages of less components, low cost, simple assembly and easy operation at the same time.

To solve the above-said technical problem, the technical solution of the present invention is:

A speaker includes a housing in which a vibration system and a magnetic system are contained, the magnetic system including a magnet and a magnetic permeability piece combined together, several slits are provided on at least one component of the magnet and the magnetic permeability piece, the depths of the respective slits all extend in a horizontal direction and the lengths of the respective slits all extend in a vertical direction.

Wherein, the respective slits are distributed on the respective components at equal spacing.

Wherein, the respective components are all of a circular or an annular structure and the extension lines of the respective slits in the depth direction all intersect with the rotation axis of the corresponding components.

Wherein, the slits on the same component are arranged with alternating depths of a larger size and a smaller size.

Preferably, the slits are provided on the magnetic permeability piece and the slits run through the magnetic permeability piece in the length direction.

As an implementation, the magnetic permeability piece includes a T-yoke and a washer, the slits being provided on the T-yoke, the respective slits all extending in the depth direction from the outer edge to the center of the T-yoke and extending onto a boss of the T-yoke; and the respective slits all run through the T-yoke in the length direction.

Wherein, the washer is of an annular structure, the slits being provided on the washer and the respective slits all extending in the depth direction from the inner edge to the outer edge of the washer.

As another embodiment, the magnetic permeability piece includes a cone frame and a washer, the slits being provided on the cone frame, the respective slits all running through an annular side wall of the cone frame in the depth direction and the respective slits all extending in the length direction from an opened end to a closed end of the cone frame.

Wherein, the washer is of a circular structure, the slits being provided on the washer and the respective slits all extending in the depth direction from the outer edge to the center of the washer.

After adopting the above-said technical solutions, the beneficial effects of the present invention are:

Because the speaker of the present invention includes a vibration system and a magnetic system, the magnetic system includes a magnet and a magnetic permeability piece combined together, several slits are provided on at least one component of the magnet and the magnetic permeability piece, the depths of the respective slits all extend in a horizontal direction and the lengths of the respective slits all extend in a vertical direction, by providing slits, the loop of the eddy current is cut off and the formation of most of the eddy current is prevented, effectively reducing the eddy current loss on the magnetic permeability component, increasing the efficiency of the speaker at high frequencies, reducing the second harmonic distortion and increasing the acoustic performance of the speaker. By providing slits on the magnetic permeability component instead of the short circuit ring in prior art, the internal components of the speaker are decreased, the production cost is reduced and at the same time the assembly process of the speaker is simplified and the production efficiency and the qualified rate of the end product of the speaker are effectively increased.

Due to the arrangement of the slits on the magnetic permeability component with alternating depths of a larger size and a smaller size, the effect of the slits on the original magnetic field distribution can also be minimized while effectively reducing the eddy current loss of the magnetic permeability component, which increases the acoustic performance of the speaker to the largest degree.

In summary, the speaker of the present invention solves the technical problems in prior art of more components, high cost, difficult assembly etc. of the speaker. The speaker of the present invention also has the advantages of less components, low production cost, simple assembly and easy operation, high production efficiency, a high qualified rate of the end product, a remarkable acoustic performance, etc. while solving the technical problems of the eddy current loss and second harmonic distortion, etc.

The above explanation is merely an outline of the technical solution of the present application. In order to be able to understand the technical means of the present application more clearly and to be able to implement it in accordance with the contents of the specification, and in order to enable the above-said and other objectives, features and advantages of the present application more evident and comprehensible, the specific embodiments of the present application are particularly described in the following.

BRIEF DESCRIPTION OF DRAWINGS

By the following description of the present invention in conjunction of the attached drawings, the above features and technical advantages of the present invention will become clearer and understandable.

Figure 1:
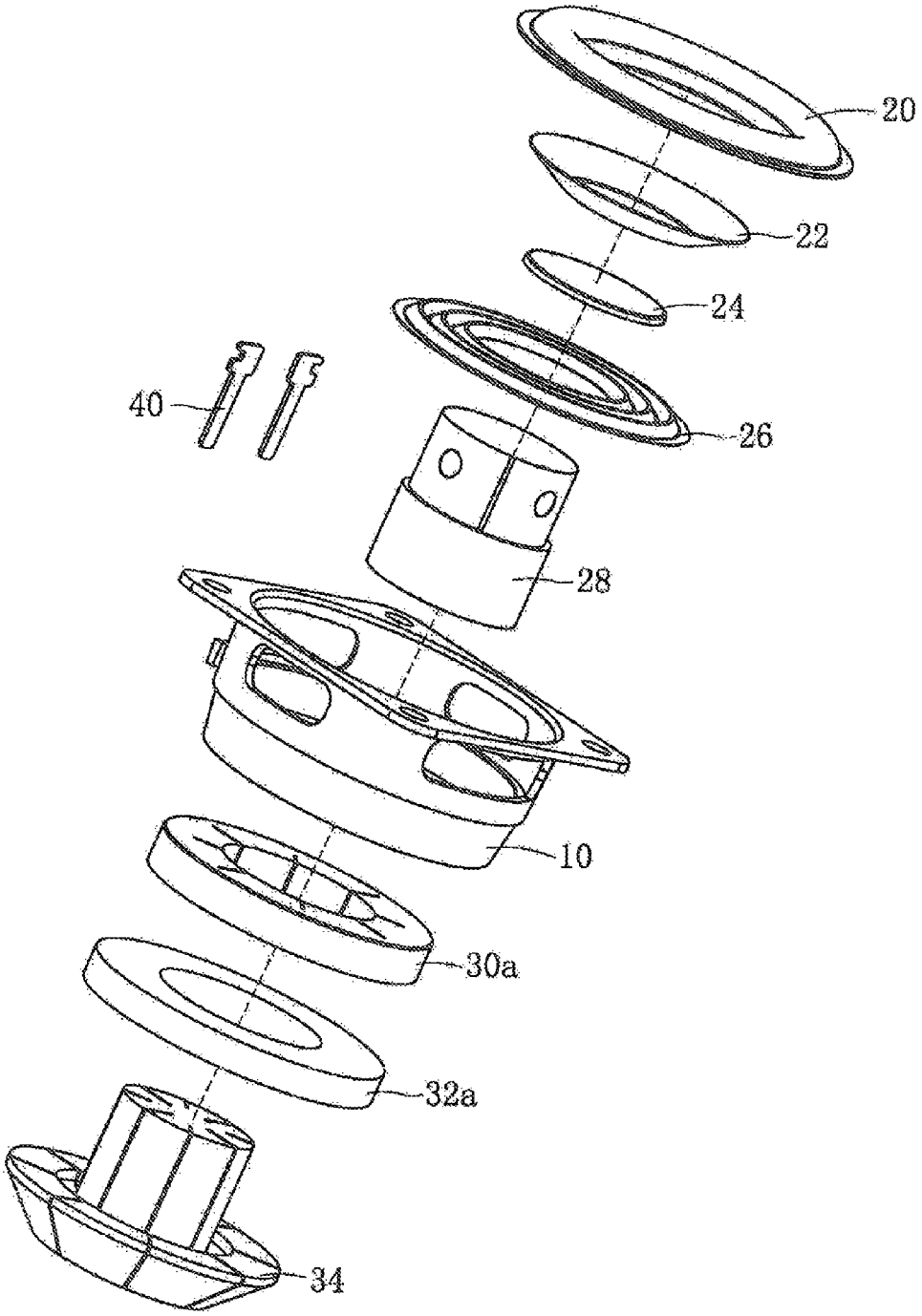
FIG. 1 is a perspective exploded schematic view of the structure of an Embodiment 1 of a speaker of the present invention.

In the drawings: 10 a housing, 20 a folding ring, 22 a connector, 24 a dome, 26 a damper, 28 a skeleton voice coil, 30*a* a washer, 30*b* a washer, 300*a* a slit, 300*b* a slit, 32*a* magnet, 32*b* magnet, 34 a T-yoke, 340 slits, 36 a cone frame, 360 a slit, 362 a groove, 40 an electrical connector.

DETAILED DESCRIPTION OF THE INVENTION

Below, the present invention will be further elaborated in connection with the attached drawings and embodiments.

The azimuth "upper" involved in the present specification all refers to the direction of the vibration system of the speaker and the azimuth "lower" all refers to the direction of the magnetic system of the speaker; the inner edge involved in the present specification all refers to the position near the center axis of the speaker and the outer edge all refers to the position near the edge of the speaker; the horizontal and vertical directions involved in the present specification both refer to an position of a horizontal orientation in which the magnetic system of the speaker is located in a lower position and the vibration system is located in an upper position.

Example 1

Figure 2:
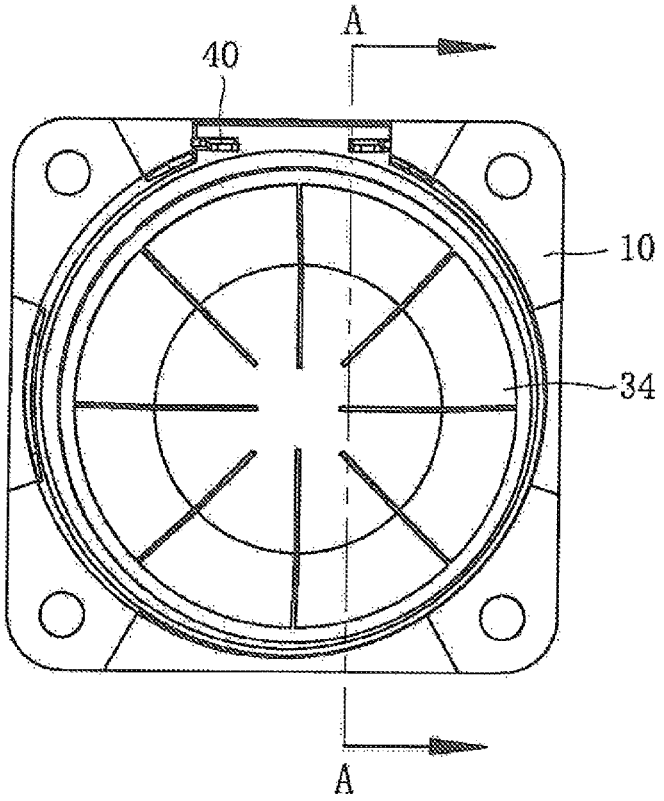
FIG. 2 is an assembled view of FIG. 1 with a T-yoke located above.
Figure 3:
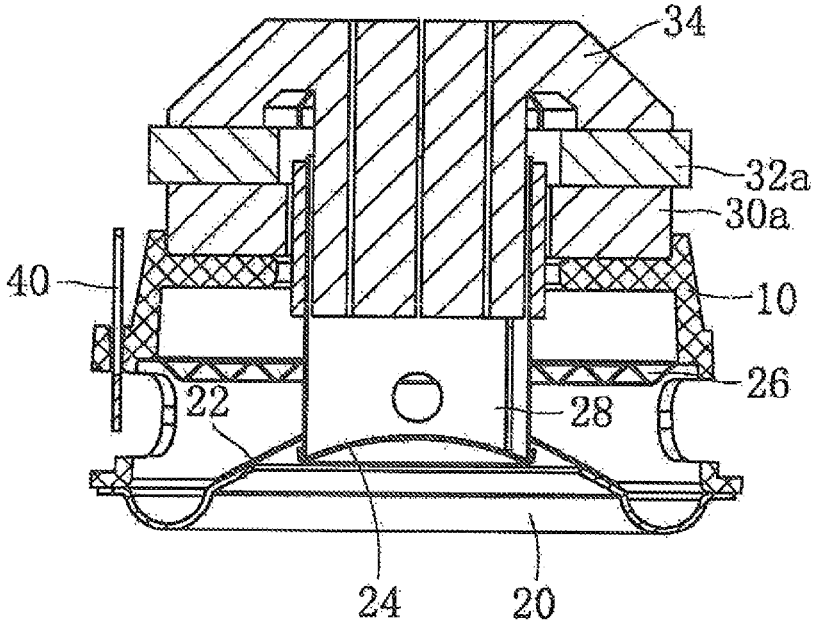
FIG. 3 is a sectional view taken along line A-A of FIG. 2.

As commonly shown in FIG. 1, FIG. 2 and FIG. 3, a speaker of a circular structure includes a housing 10 of an annular structure with two open ends. The vibration system and the magnetic system are contained inside the housing 10. The vibration system includes a folding ring 20 the outer edge of which is fixed on the upper end face of the housing 10. An annular connector 22 with one end having a large opening and another end haling a small opening is fixed on the inner edge of the folding ring 20. The end of the connector 22 having a large opening is connected to the folding ring 20, and the end of the connector 22 having a small opening is connected to a dome 24 on which a skeleton voice coil 28 is fixed. A damper 26 is fixed in the outer periphery of the skeleton voice coil 28. The outer edge of the damper 26 is fixed on the housing 10. Windings are wound on one end of the skeleton voice coil 28, and another end of the skeleton voice coil 28 on which no windings are wound is connected to the dome 24. The damper 26 surrounds around the position of the skeleton voice coil 28 where no windings are wound. The magnetic system includes a magnet 32*a* and a magnetic permeability piece. The magnetic permeability piece includes a T-yoke 34 and a washer 30*a*. The T-yoke 34 includes a circular base. A cylindrical boss is provided in the central position of the base. The annular magnet 32*a* and the washer 30*a* are sequentially fixed on the base of the T-yoke 34. The washer 30*a* is fixed with the housing 10. A magnetic gap is remained between the magnet 32*a* and the washer 30*a* with the boss of the T-yoke 34. The end of the skeleton voice coil 28 on which windings are wound is located within the magnetic gap. The skeleton voice coil 28 makes up and down movement within the magnetic gap according to the magnitude and direction of the acoustic electrical signal passing through the windings thereof. The three components of the dome 24, the connector 22 and the folding ring 20 vibrate along with the up and down movement of the skeleton voice coil 28 at the same time, which drives the air to sound, so as to complete the electro-acoustic energy conversion.

Figure 4:
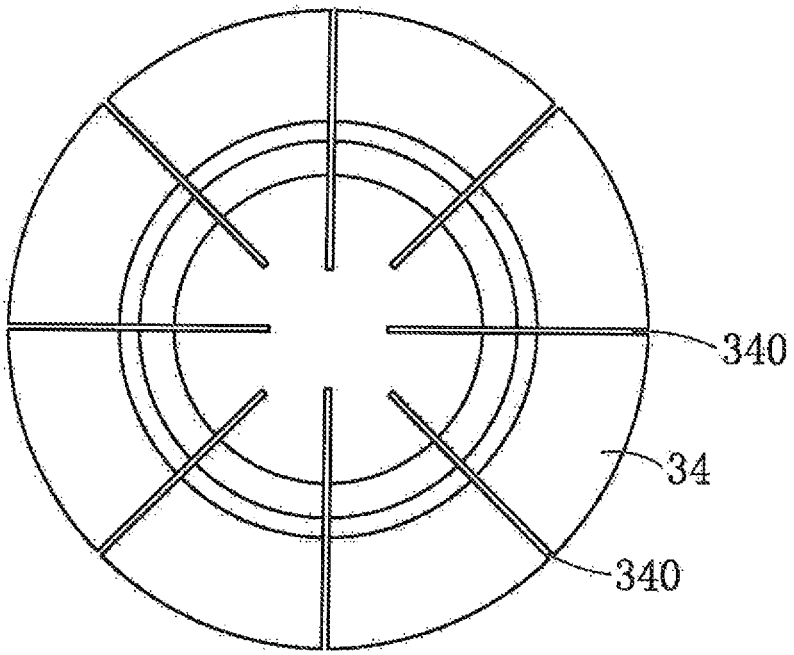
FIG. 4 is a top schematic view of the structure of the T-yoke in FIG. 1.

As commonly shown in FIG. 1 and FIG. 4, slits 340 are provided on the T-yoke 34. Eight slits 340 are provided in total. The depths of the eight slits 340 are all set to extend in the horizontal direction and the lengths all extend in the vertical direction. The eight slits 340 are distributed on the T-yoke 34 at equal spacing, and the extension lines of the eight slits 340 in the depth direction all intersect with the rotation axis of the T-yoke 34 and are arranged pairwise symmetrically relative to the rotation axis of the T-yoke 34. The eight slits 340 all extend in the depth direction from the outer edge to the center of the T-yoke 34 and extend onto the boss of the T-yoke 34. The eight slits 340 all run through the whole T-yoke 34 in the length direction.

As shown in FIG. 4, one of the two adjacent slits 340 has a depth of a larger size and another has a smaller size. That is, the eight slits 340 are arranged on the T-yoke 34 with alternating depths of a larger size and a smaller size. The arrangement of the eight slits 340 with alternating depths of a larger size and a smaller size can also minimize the effect of the slits on the original magnetic field distribution while effectively reducing the eddy current loss of the magnetic permeability component, which increases the acoustic performance of the speaker to the largest degree.

Figure 5:
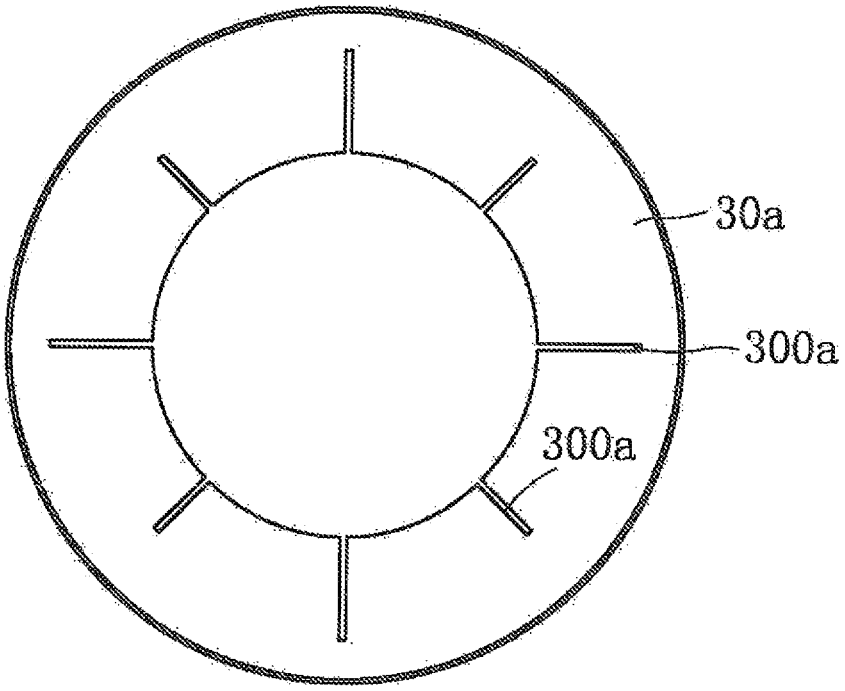
FIG. 5 is a top schematic view of the structure of the washer in FIG. 1.

As commonly shown in FIG. 1 and FIG. 5, slits 300*a* are also provided on the washer 30*a*. Eight slits 300*a* are provided in total as well. The eight slits 300*a* are distributed on the washer 30*a* at equal spacing, and the extension lines of the eight slits 300*a* in the depth direction all intersect with the rotation axis of the washer 30*a* and are arranged pairwise symmetrically relative to the rotation axis of the washer 30*a*. The slits 300*a* all extend in the depth direction from the inner edge to the outer edge of the washer 30*a* and all run through the whole washer 30*a* in the length direction. The eight slits 300*a* are also arranged on the washer 30*a* with alternating depths of a larger size and a smaller size.

The slits can be provided only on one component of the washer 30*a*, the magnet 32*a* and the T-yoke 34, or also can be provided on these three components. The slits being provided only on the washer 30*a* and the T-yoke 34 is a preferred solution of the present invention. Because the effect of reducing the eddy current loss by only providing slits on one component is not enough, and also because providing slits on the magnet 32*a* will increase the cost, the slits are only provided on the washer 30*a* and the T-yoke 34 in the present invention. If slits are provided on the magnet 32*a*, the structure of the slits thereof is the same as that of the slits 300*a* on the washer 30*a*.

As commonly shown in FIG. 1, FIG. 2 and FIG. 3, an electrical connector 40 for electrically connecting the skeleton voice coil 28 and the external circuit of the speaker is also fixed on the housing 10.

Example 2

Figure 6:
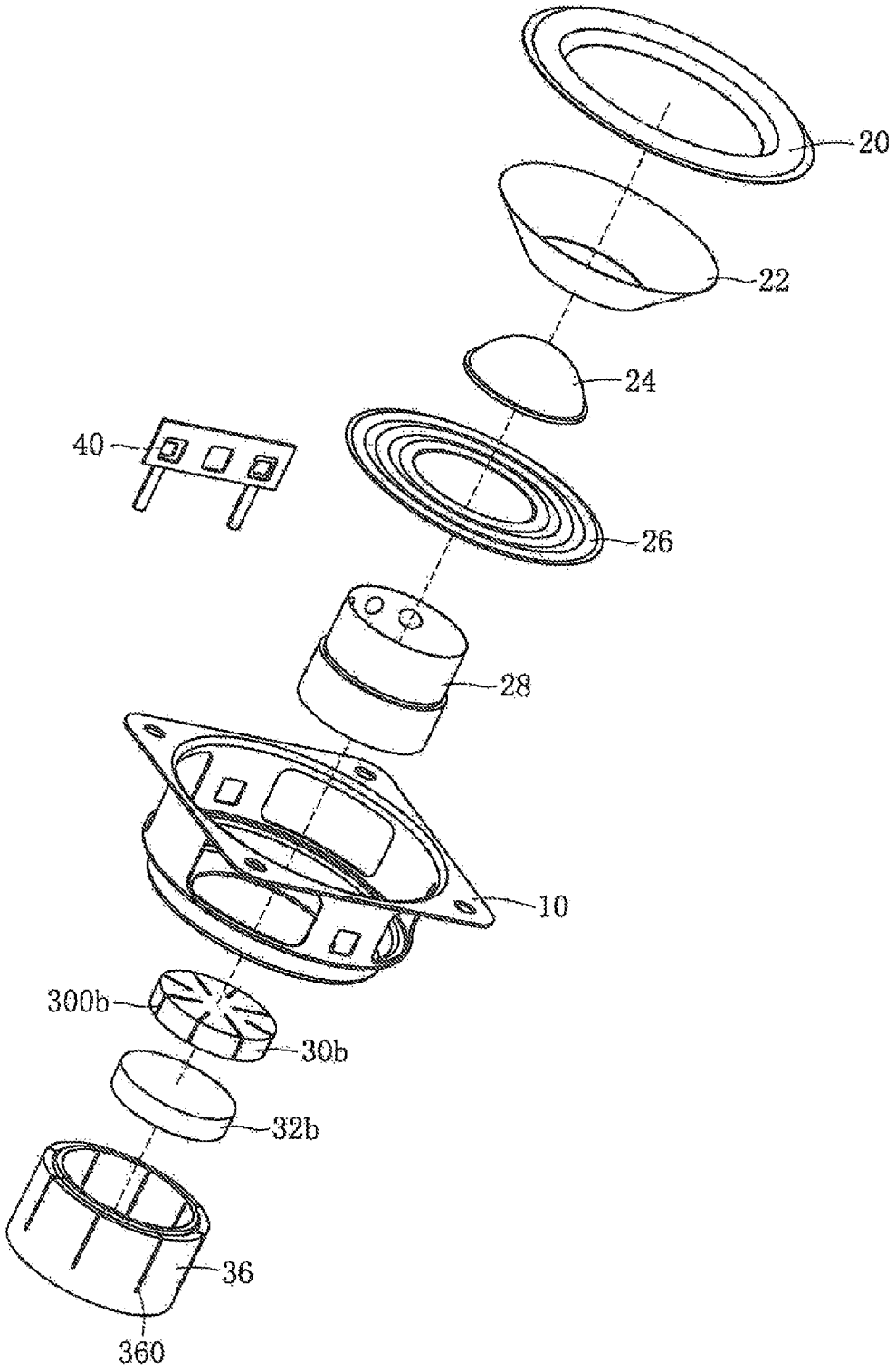
FIG. 6 is a perspective exploded schematic view of the structure of an Embodiment 2 of a speaker of the present invention.
Figure 7:
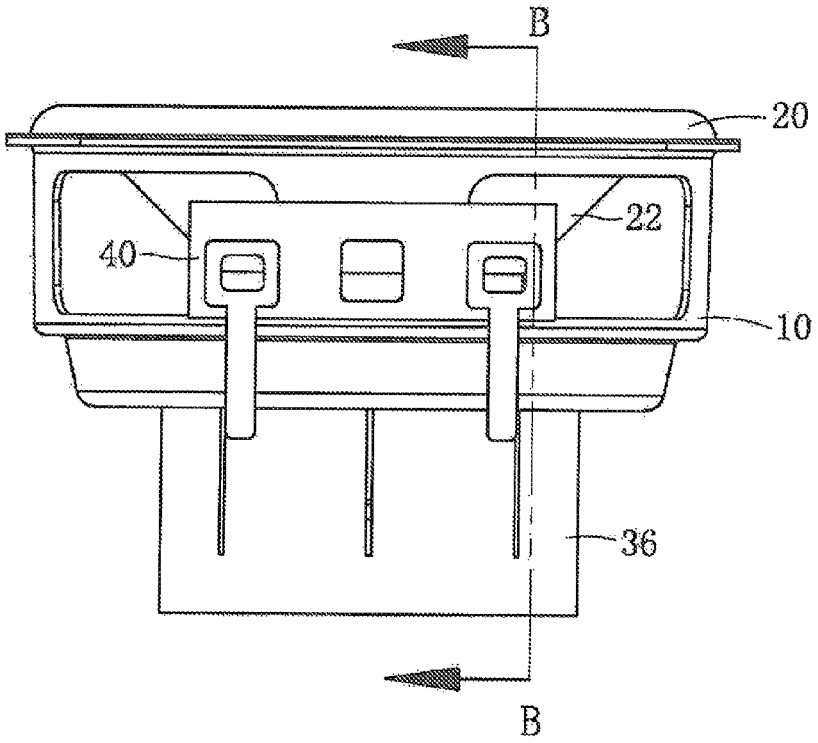
FIG. 7 is an assembled view of FIG. 6.
Figure 8:
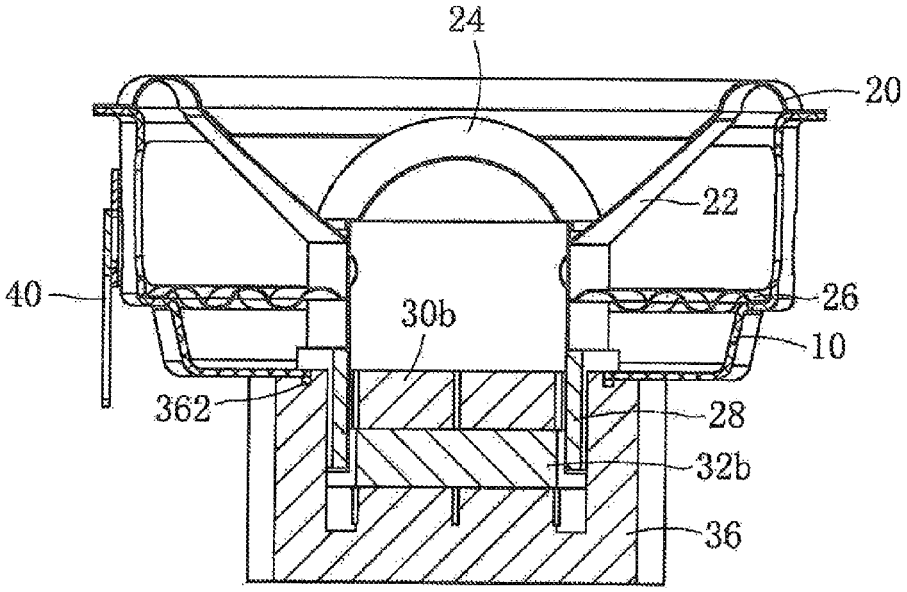
FIG. 8 is a sectional view taken along line B-B of FIG. 7.

The present embodiment is substantially the same as the Example 1 with the following differences:

As commonly shown in FIG. 6, FIG. 7 and FIG. 8, the magnetic permeability piece of the magnetic system includes a cone frame 36 and a washer 30*b*. The cone frame 36 includes a circular bottom and an annular side wall vertically surrounding the edge of the bottom. A circular boss is provided in the central position of the bottom of the cone frame 36. On the circular boss are sequentially fixed a circular magnet 32*b* and the washer 30*b* of a diameter the size of which is the same as that of the boss. The end portion of the side wall of the cone frame 36 is fixed with the housing 10.

As shown in FIG. 6, slits 360 are provided on the cone frame 36. Eight slits 360 are provided in total. The eight slits 360 all run through the side wall of the cone frame 36 in the depth direction and extend onto the boss; and all extend in the length direction from the opened end to the closed end of the cone frame 36, but extend only to the junction of the boss and the bottom, and do not extend to the bottom. That is, the slits 360 do not run through the entire cone frame in the length. The eight slits 360 are arranged on the boss with alternating depths of a larger size and a smaller size. The extension lines of the eight slits 360 in the depth direction all intersect with the rotation axis of the cone frame.

As shown in FIG. 6, slits 300*b* are provided on the washer 30*b*. Eight slits 300*b* are also provided in total. The eight slits 300*b* all extend in the depth direction from the outer edge to the center of the washer 30*b* and are arranged with alternating depths of a larger size and a smaller size.

As commonly shown in FIG. 6 and FIG. 8, an annular groove 362 coaxial with the cone frame 36 is provided on the end face of the side wall of the cone frame 36. The end face of the side wall inside the groove 362 is higher than the end face of the side wall outside. The bottom of the housing 10 overlaps on the end face of the side wall of the groove 362 with a lower height and abuts against the side wall with a higher height, and the inner surface of the bottom of the housing 10 is flush with the end face of the side wall with the higher height. No slit 360 is provided on the portion of the side wall with the height higher than the side wall with the lower height.

In the present invention, by providing slits on the magnetic permeability component, the loop of the eddy current is cut off and the formation of most of the eddy current is prevented, effectively reducing the eddy current loss on the magnetic permeability component, increasing the efficiency of the speaker at high frequencies, reducing the second harmonic distortion and increasing the acoustic performance of the speaker. Because the technical problem of generating the eddy current on the magnetic permeability component is effectively solved by providing slits on the magnetic permeability component, it is not necessary to add a short circuit ring in the speaker, which decreases the internal components of the speaker, reducing the production cost and at the same time simplifying the assembly process of the speaker and effectively increasing the production efficiency and the qualified rate of the end product of the speaker.

In both examples described above, eight slits are provided on each magnetic permeability component. This is a preferred embodiment after many consideration by the inventor according to the effect of reducing the eddy current loss and the effect on the original magnetic field of the speaker and so on. In practical application, the number of the slits is not limited to eight and it can be determined by those skilled in the art according to the volume of the magnetic permeability component and the performance requirement of the speaker. As for the specific embodiment provided with another number of slits, it is substantially the same as both examples described above, therefore the specific embodiment provided with another number of slits will not be specifically discussed herein.

In the present invention, the technical solution of providing slits on the magnetic permeability component according to the present invention has been set forth in detail only by exemplifying the speaker described in the above-described two examples. However, in practical application, this technical solution is not limited to be applied into the speaker of the above-described two structures. As long as it is a product in which slits are provided on the magnetic permeability component and these slits are used for reducing the eddy current loss on the magnetic permeability component, reducing the second harmonic distortion and for increasing the acoustic performance of the speaker, it falls into the protection scope of the present invention.

The present invention is not limited to the above-said specific embodiment, and various modifications made by those ordinary skilled in the art starting from the above-said concept and without requiring creative labor, fall into the protection scope of the present invention.

The invention claimed is:

1. A speaker including a housing, a vibration system and a magnetic system are received in the housing, the magnetic system includes a magnet and a magnetic permeability piece combined together, characterized in that, several slits are provided on the magnetic permeability piece, the depths of the respective slits all extend in a horizontal direction and the lengths of the respective slits all extend in a vertical direction:

the magnetic permeability piece including one of:

a T-yoke and a washer, the slits are provided on the T-yoke, the washer is of an annular structure, and the slits being provided on the washer; and a cone frame and a washer, the slits are provided on the cone frame, the washer is of a circular structure, and the slits are provided on the washer.

2. The speaker according to claim 1, characterized in that, the respective slits are distributed on the respective components at equal spacing.

3. The speaker according to claim 2, characterized in that, the respective components are all of a circular or an annular structure and the extension lines of the respective slits in the depth direction all intersect with the rotation axis of the corresponding components.

4. The speaker according to claim 3, characterized in that, the slits on the same component are arranged with alternating depths of a larger size and a smaller size.

5. The speaker according to claim 4, characterized in that, the slits run through the magnetic permeability piece in the length direction.

6. The speaker according to claim 5, characterized in that, the respective slits all extend in the depth direction from the outer edge to the center of the T-yoke and extend onto a boss of the T-yoke; and the respective slits all run through the T-yoke in the length direction.

7. The speaker according to claim 6, characterized in that, the respective slits all extend in the depth direction from the inner edge to the outer edge of the washer.

8. The speaker according to claim 5, characterized in that, the respective slits all run through an annular side wall of the cone frame in the depth direction and the respective slits all extend in the length direction from an opened end to a closed end of the cone frame.

9. The speaker according to claim 8, characterized in, that, the respective slits all extend in the depth direction from the outer edge to the center of the washer.

* * * * *